US007464448B2

(12) United States Patent
Kolasa

(10) Patent No.: US 7,464,448 B2
(45) Date of Patent: Dec. 16, 2008

(54) SIDE-RELEASE BUCKLE ASSEMBLY

(75) Inventor: Scott D. Kolasa, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/855,435

(22) Filed: Sep. 14, 2007

(65) Prior Publication Data

US 2008/0086853 A1 Apr. 17, 2008

Related U.S. Application Data

(60) Provisional application No. 60/851,199, filed on Oct. 12, 2006.

(51) Int. Cl.
*A44B 11/26* (2006.01)

(52) U.S. Cl. ..... 24/616

(58) Field of Classification Search ..... 24/614–616, 24/625

(56) References Cited

U.S. PATENT DOCUMENTS

| | | | | |
|---|---|---|---|---|
| 3,430,306 | A * | 3/1969 | Georges | 24/593.1 |
| 4,577,377 | A | 3/1986 | Kasai | |
| 5,027,481 | A * | 7/1991 | Frano | 24/606 |
| 5,311,649 | A * | 5/1994 | Suh | 24/625 |
| 6,560,830 | B1 | 5/2003 | Chi | |
| 2007/0089280 | A1 * | 4/2007 | Pontaoe | 24/614 |

* cited by examiner

*Primary Examiner*—James R Brittain
(74) *Attorney, Agent, or Firm*—Mark W. Croll; Paul F. Donovan

(57) ABSTRACT

A buckle assembly includes a first connection member and a second connection member. The first connection member includes engagement members, such as buttons. The second connection member is configured to connect to the first connection member, and includes openings in which the engagement members are retained when the first connection member is connected to the second connection member. The second connection member also includes release arms configured to be actuated to engage the engagement members in order to disconnect the first connection member from the second connection member.

20 Claims, 5 Drawing Sheets

SIDE-RELEASE BUCKLE ASSEMBLY

RELATED APPLICATIONS

This application relates to and claims priority benefits from U.S. Provisional Patent Application 60/851,199 entitled "Buckle Assembly," filed Oct. 12, 2006, which is hereby incorporated by reference in its entirety.

FIELD OF THE INVENTION

Embodiments of the present invention generally relate to a buckle assembly, and more particularly to a side-release buckle assembly.

BACKGROUND OF THE INVENTION

A conventional side-release buckle assembly includes a male connection member that is configured to mate with a female connection member, such as shown and described in U.S. Pat. No. 5,465,472, entitled "Buckle." Each connection member is configured to retain a strap, such as a seatbelt or backpack strap. The male connection member includes integral buttons that may be engaged to release the male connection member from the female connection member, thereby disconnecting the buckle assembly.

FIG. 1 illustrates a top view of a disconnected conventional buckle assembly 10. The buckle assembly 10 includes a male connection member 12 and a female connection member 14. The male connection member 12 includes a pair of flexible lateral arms 16 having buttons 18 at distal ends 20. A rigid strut member 22 extends between the lateral arms 16. A strap receiving channel 21 is formed through the male connection member 12 between the rigid strut member 22 and a strap bar 23, which is configured to clamp into a strap. The lateral arms 16 are configured to pivot in the direction of arcs A and A' about pivot points 24 defined by the union of the rigid strut member 22 and the lateral arms 16. In general, the rigid strut member 22 is disposed between the pivot points 24 and the strap-receiving channel 21. As such, the pivot points 24 are distally located from the strap bar 23. As shown in FIG. 1, the rigid strut member 22 extends between the arms 16 and is integrally connected to a main body 25 of the male connection member 12. Thus, the rigid strut member 22 is inflexible.

In order to secure the male connection member 12 into the female connection member 14, the male connection member 12 is urged into the female connection member 14 in the direction of arrow B. A guide beam 26 of the male connection member 12 moves into a reciprocal channel (not shown) formed in the female connection member 14 to ensure proper mating alignment between the male and female connection members 12 and 14, respectively. As the male connection member 12 is urged into the female connection member 14, the lateral arms 16 deflect inwardly in the directions of arcs A and A' until the buttons 18 reach button openings 28 formed through the female connection member 14. When the buttons 18 enter the button openings 28, the tension stored in the lateral arms 16 snapably forces the lateral arms 16 and the buttons laterally outward, so that the buttons 18 are secured within the button openings 28. At this point, the male connection member 12 is secured to the female connection member 14.

FIG. 2 illustrates a top view of the conventional buckle assembly 10 in which the male connection member 12 is securely mated into the female connection member 14. In order to disconnect the male connection member 12 from the female connection member 14, the buttons 18 are squeezed toward one another in the direction of arcs A and A'.

Referring to FIGS. 1 and 2, in general, the longer the lateral arms 16 are, the easier it is for a user to push the buttons 18 inward. Because of the configuration of the rigid strut member 22 and associated pivot points 24, however, the size of the arms 16 and buttons 18 is limited. Further, if the arms 16 are too large, the arms 16 are not easily deflected due to the force exerted into the arms 16 by the rigid strut member 22.

Moreover, the button openings 28 formed in the female connection member 14 may be too small to allow a user to manipulate the buttons 18. As shown in FIG. 2, the buttons 18 are bound on three sides by fixed, rigid structure of the female connection member 14 that defines the button openings 28. If an operator is wearing gloves, or has oversized fingers, the fixed structural support walls of the female connection member 14 that define the button openings 28 may interfere with the operator's fingers, thereby impeding further squeezing of the buttons 18. As such, an operator may find it difficult, or impossible, to disconnect the male connection member 12 from the female connection member 14.

As discussed above, the male connection member 12 is urged into the female connection member 14. In snowy conditions, however, some conventional buckle assemblies, such as the buckle assembly 10, may become clogged with snow, rendering connection difficult. That is, snow or other debris may become trapped within the female connection member 14, thereby rendering full and proper mating with the male connection member 12 difficult or impossible.

Additionally, the webbing adjustment areas of the conventional buckle assembly 10 are not always easily accessible because the main bodies of the male and female connection members 12 and 14 may interfere with an operator's fingers and/or the strap/web material during adjustment. Thus, an operator may find it difficult to adjust webbing or straps positioned within the strap receiving channels of the male and female connection members 12 and 14.

SUMMARY OF THE INVENTION

Embodiments of the present invention provide a robust buckle assembly having mating components that are easily connected and disconnected when desired. Additionally, embodiments of the present invention are less susceptible to being clogged with snow or debris as compared to conventional buckle assemblies.

Certain embodiments of the present invention provide a buckle assembly that includes a first buckle connector, or first connection member, and a second buckle connector, or second connection member. The first and second buckle connectors or connection members may be male and female buckle connectors or connection members.

The first buckle connector includes engagement members, such as buttons. The second buckle connector is configured to connect to said first buckle connector and includes openings in which the engagement members are retained when the first buckle connector is connected to the second buckle connector, and release arms that are configured to be actuated to engage the engagement members within the openings in order to disconnect the first buckle connector from the second buckle connector.

The first buckle connector may also include an extension beam and locking arms angled with respect to the extension beam. The engagement members may be located on distal ends of the locking arms.

The first buckle connector may also include a portion that extends through the second buckle connector when the first buckle connector is connected to the second buckle connector. During a connection process, the extending portion pushes foreign substances within the second buckle connector through a passage of the second buckle connector.

One or both of the buckle connectors include a main body connected to a strap beam. The strap beam may be recessed with respect to the main body in order to facilitate easy strap/web adjustment, and to provide a clear area for foreign substances to exit from the passage.

The release arms may include protuberances inwardly directed toward the openings. The protuberances are configured to pass into the openings and force the engagement members inward when the first buckle connector is being disconnected from the second buckle connector.

Figure 1:
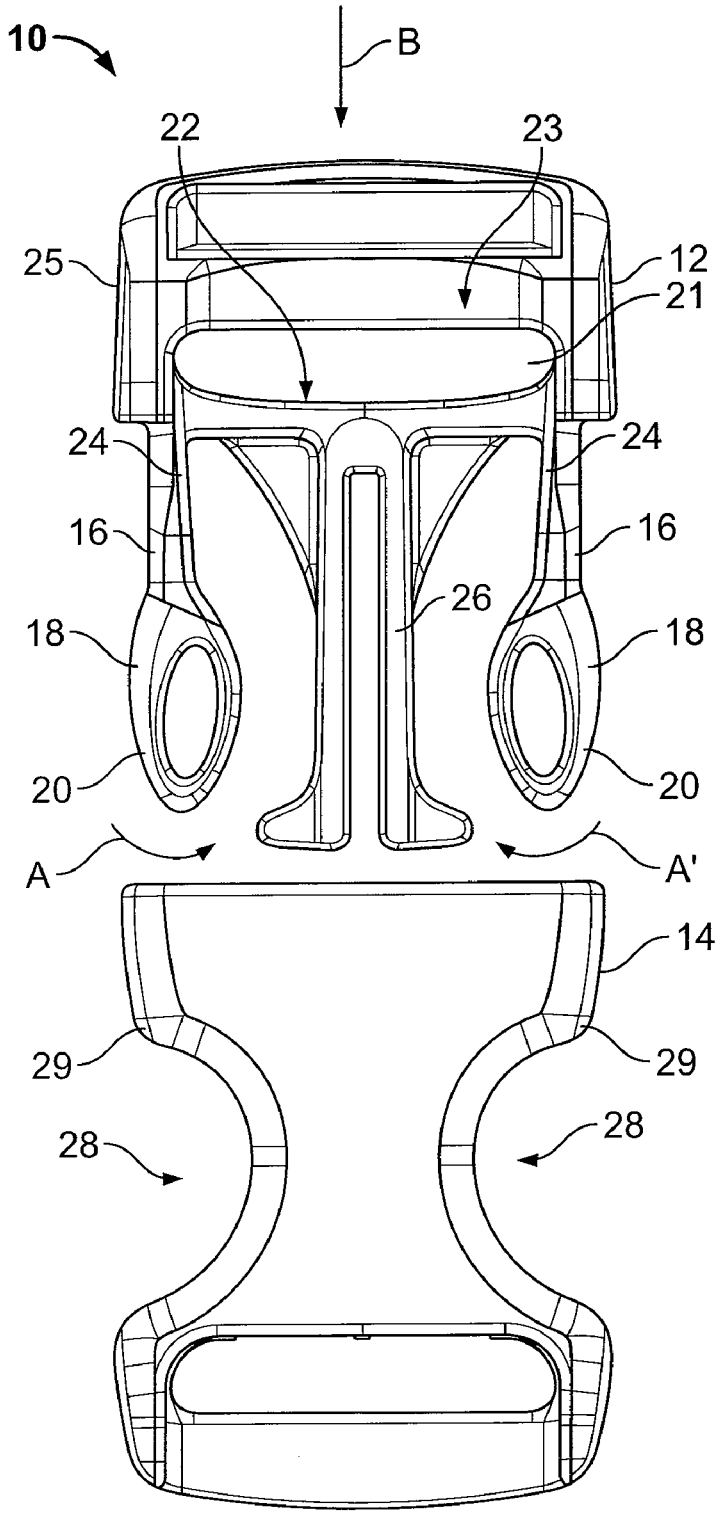
FIG. 1 (Prior Art)
FIG. 1 illustrates a top view of a disconnected conventional buckle assembly.
Figure 2:
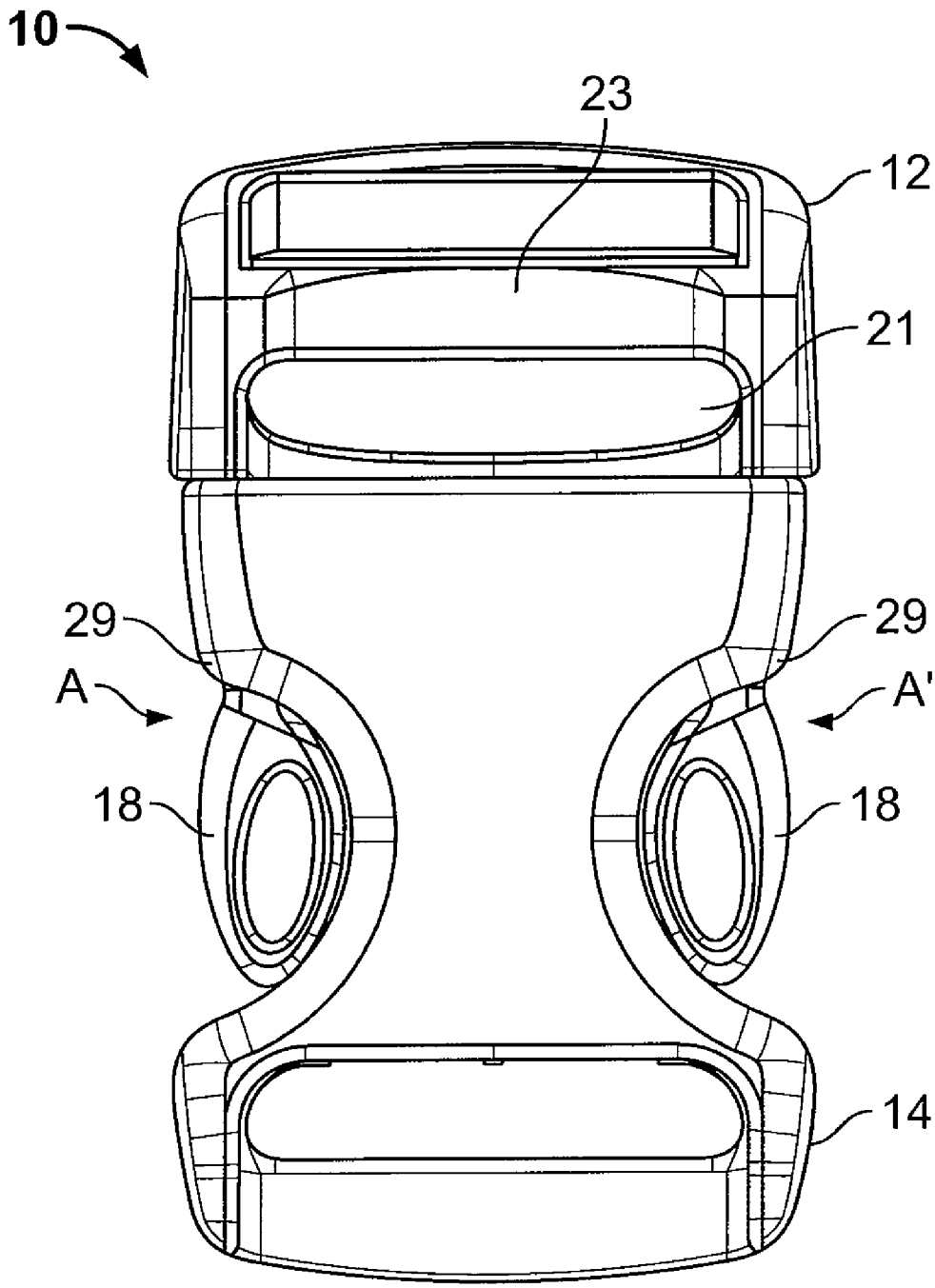
FIG. 2 (Prior Art)
FIG. 2 illustrates a top view of a conventional buckle assembly.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 3:
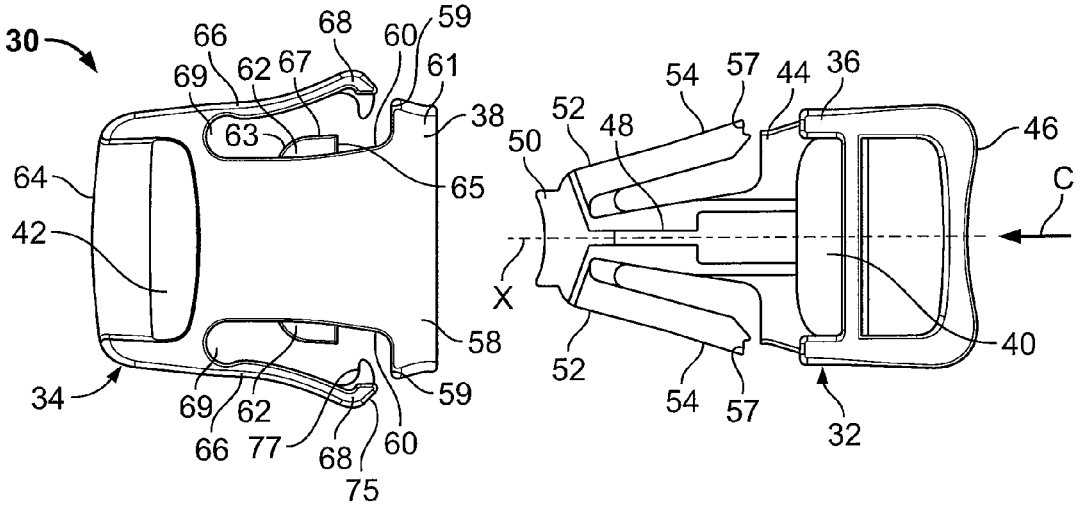
FIG. 3 illustrates a top view of a disconnected buckle assembly according to an embodiment of the present invention.
Figure 4:
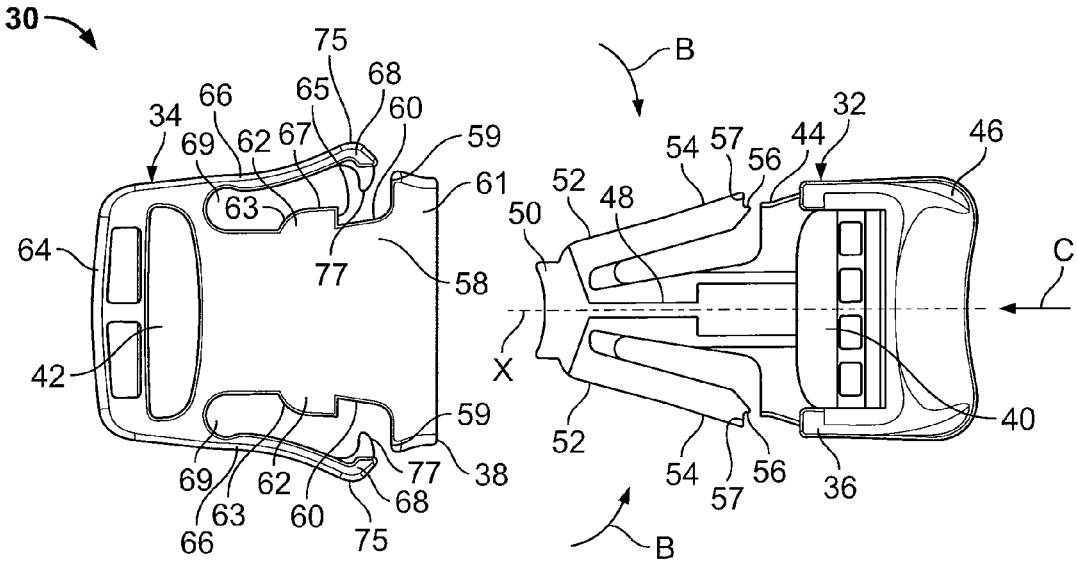
FIG. 4 illustrates a bottom view of a disconnected buckle assembly according to an embodiment of the present invention.

FIGS. 3 and 4 illustrate top and bottom views, respectively, of a disconnected buckle assembly 30 according to an embodiment of the present invention. The buckle assembly 30 includes a male connection member 32, or male buckle connector, that is configured to mate with a female connection member 34, or female buckle connector. Both the male and female connection members 32 and 34 include main bodies 36 and 38, respectively, that include strap channels 40 and 42, respectively, one or both of which may be configured to slidably retain a strap therein.

The main body 36 of the male connection member 32 includes a rigid cross beam 44 integrally connected to a strap beam 46. The strap channel 40 is formed between the cross beam 44 and the strap beam 46. An extension beam 48 outwardly extends from the cross beam 44, and may be formed perpendicular with respect to the cross beam 44. As shown in FIGS. 3 and 4, for example, the extension beam 48 may be aligned with and located about a longitudinal axis X of the male connection member 32. The extension beam 48 includes a blunted distal tip 50.

Flexible locking arms 52 are inwardly angled from the blunted distal tip 50 such that the locking arms 52 spread further out toward the cross beam 44. That is, as shown in FIGS. 3 and 4, the width of the two locking arms 52 is smallest proximate the blunted distal tip 50, and greatest at free ends 54 of the locking arms 52. As shown in FIGS. 3 and 4, the extension beam 48 and the locking arms 52 form a blunted arrowhead or inverted trident shape. The free ends 54 of the locking arms 52 include buttons 56 that may include clasps, barbs, edges, or the like that are configured to latch onto reciprocal features of the female connection member 34.

The main body 38 of the female connection member 34 includes a shroud 58 that defines an inner chamber (not shown). Button openings 60 are formed in the shroud 58 and are configured to retain the buttons 56 formed at the free ends 54 of the locking arms 52. The button openings 60 are bounded on three sides. Stops 62 are located on one side of each button opening 60. The stops 62 extend outwardly from both sides of the shroud 58. Each stop 62 includes a rounded end 63 integrally connected to a web stop edge 65 by an intermediate extension portion 67. The stops 62 are configured to block a strap or web material connected to the female connection member 34 from passing into the button openings 60 or any other stray strap or web material from passing into the button openings. Additionally, the stops 62, along with adjoining structure of the shroud 58, may be configured to snapably, latchably, or otherwise securely engage the buttons 56 when the male connection member 32 connects to the female connection member 34.

The shroud 58 is integrally connected to a strap beam 64 such that the strap channel 42 is defined between the shroud 58 and the strap beam 64. As discussed below, the strap beam 64 is recessed below the main body 38 of the female connection member 34. Flexible release arms 66 extend from the strap beam 64 on either side of the shroud 58 and are separated from lateral walls of the shroud 58 by clearance gaps 69. Button actuating protuberances 68 are located at distal ends of the release arms 66. The protuberances 68 are configured to engage the buttons 56 during a disconnection process. The protuberances 68 include base portions 75 integrally connected to engagement surfaces 77. The base portions 75 outwardly bow, while the engagement surfaces 77 curve in toward the button openings 60, thereby providing a cam-like extension that is configured to move deep into the button openings 60 when the release arms 66 are squeezed.

In order to connect the male connection member 32 to the female connection member 34, the male connection member 32 is urged into the inner chamber of the shroud 58 in the direction of arrow C. As the male connection member 32 passes into the inner chamber, the locking arms 52 inwardly flex until the buttons 56 reach the button openings 60, at which point the locking arms 52 snap back and the buttons 56 are secured in the button openings 60. Flat edges 57 of the buttons 56 are configured to latchably engage trailing edges 59 of a mating collar 61 of the shroud 58 when the male connection member 32 connects to the female connection member 34.

As noted above, the locking arms 52 are angled with respect to the extension beam 48. The locking arms 52 spread out from the blunted distal tip 50 toward the cross beam 44. Further, the lateral surfaces of the locking arms 52 are flat and straight. During the connection process, foreign substances, such as snow, debris or the like within the inner chamber of the shroud 58 are pushed by the locking arms 52 into and out of the button openings 60. As the male connection member 32 continues to pass into the female connection member 34, the locking arms 52 shunt snow, debris or the like out through the button openings 60. It has been found that the angled nature of the locking arms 52 efficiently moves and shunts foreign substances out of the shroud 58 during the connection process.

Figure 5:
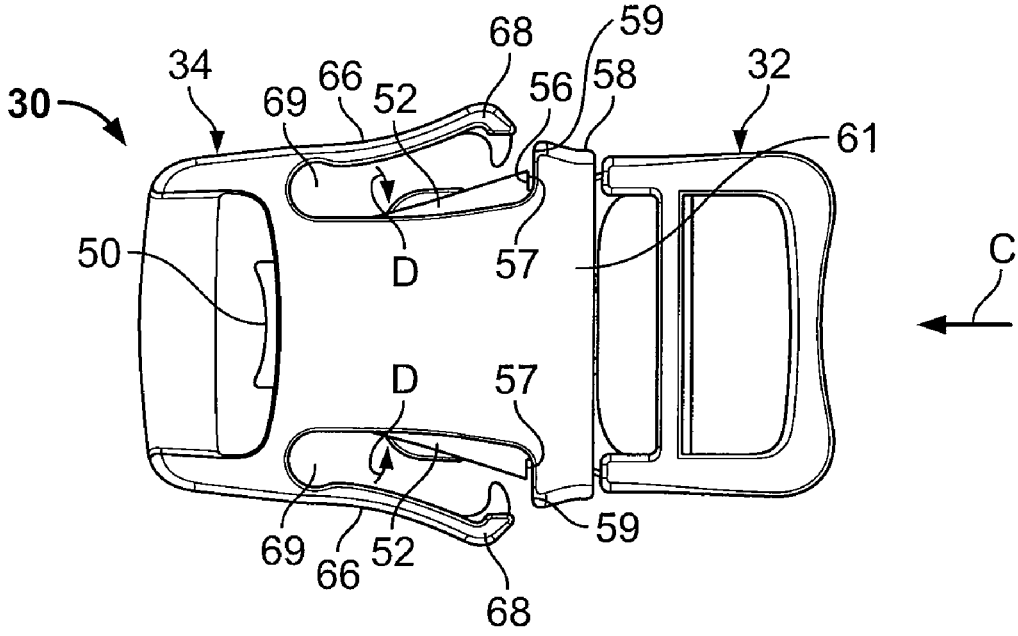
FIG. 5 illustrates a top view of a connected buckle assembly according to embodiment of the present invention.
Figure 6:
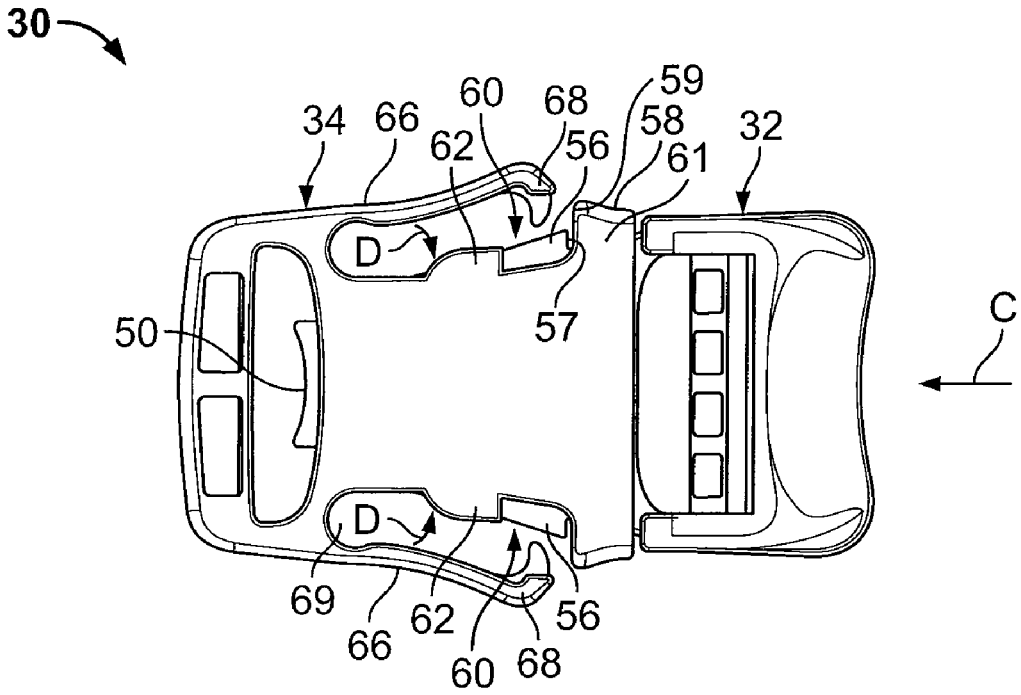
FIG. 6 illustrates a bottom view of a connected buckle assembly according to an embodiment of the present invention.

FIGS. 5 and 6 illustrate top and bottom views, respectively of the connected buckle assembly 30. As shown in FIGS. 5 and 6, the blunted distal tip 50 of the extension beam 48 (hidden from view in FIGS. 5 and 6) passes through the shroud 58. That is, the shroud 58 includes a channel formed therethrough that aligns with the extension beam 48 during a connection process. Thus, any snow, debris or the like that is within the inner chamber of the shroud 58 is engaged by the blunted distal end 58 as the male connection member 32 is urged into the female connection member 34. As the male connection member 32 continues to move into the inner chamber of the shroud 58, the blunted distal tip 50 pushes any snow, debris or the like through the channel formed through the shroud 58 and out an open passage of the channel. Thus, connection of the male connection member 32 to the female connection member 34 is not hindered by the presence of the snow, debris or the like that may be in the shroud 58 due to the fact that the blunted distal tip 50 of the extension beam 48 pushes any such snow, debris or the like through the open passage of the channel formed through the shroud 58. The combined shape of the blunted distal tip 50 and the inwardly-angled locking arms 52 acts as a plow that efficiently clears foreign substances from the inner chamber of the shroud 58.

In order to disconnect the male connection member 32 from the female connection member 34, an operator engages the flexible release arms 66 and squeezes them toward one another. During the squeezing process, the release arms 66 inwardly flex into the clearance gaps 69 in the directions of arcs D. As the release arms 66 are squeezed toward one another, the protuberances 68 are urged into the buttons 56. With increased squeezing force, the protuberances move further into the button openings 60, thereby forcing the buttons 56 and locking arms 52 to inwardly flex. As the buttons 56 move inward, the buttons 56 lose contact with the trailing edges 59 of a mating collar 61 of the shroud 58 and adjoining portions of the shroud 58. Thus, the buttons 56 are no longer retained within the button openings 60, and the male connection member 32 may be removed from the female connection member 34.

The release arms 66 provide large surfaces for an operator to engage and manipulate. During disconnection, the operator engages the easily engageable release arms 66, but not the buttons 56, which are bounded on three sides by the shroud 58. The engagement surfaces 77 of the protuberances 68 engage the buttons 56. An operator may easily grasp and squeeze the release arms 66 without being blocked by rigid structural portions of the assembly 30. Because the protuberances 68 of the release arms 66 contact the buttons 56 during disconnection, an operator is able to easily disconnect the male connection member 32 from the female connection member 34 without being blocked by rigid support walls that define the button openings 60. Thus, even if an operator is wearing gloves, or has oversized fingers, the fixed structural support walls that define the button openings 60 do not interfere with the operator's fingers.

During disconnection, the stops 62 prevent straps or webbing from sliding into the button openings 60. As such, the stops 62 prevent damage to the release arms 66 (e.g., the release arms 66 could be damaged if moved into button openings 60 that were clogged with webbing material).

Figure 7:
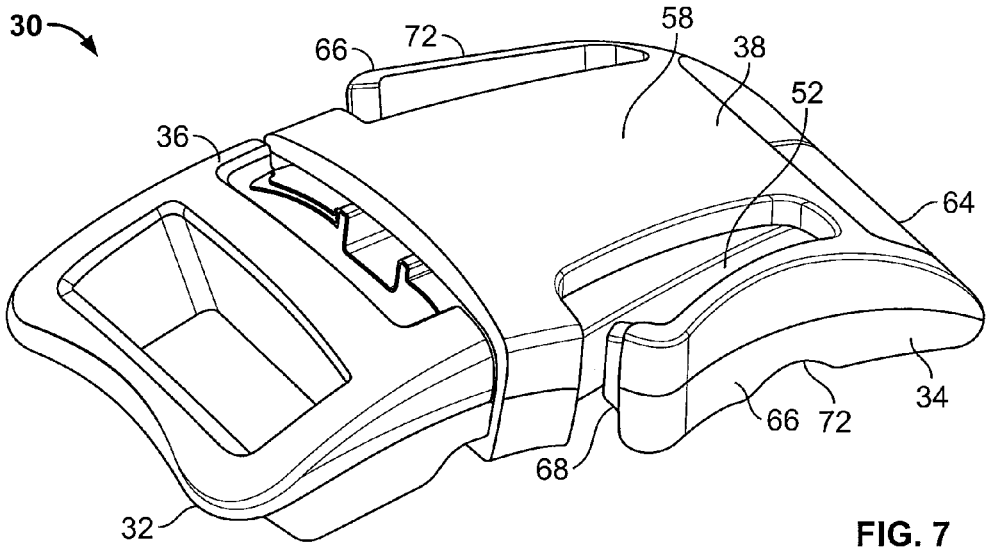
FIG. 7 illustrates an isometric top view of a connected buckle assembly according to an embodiment of the present invention.
Figure 8:
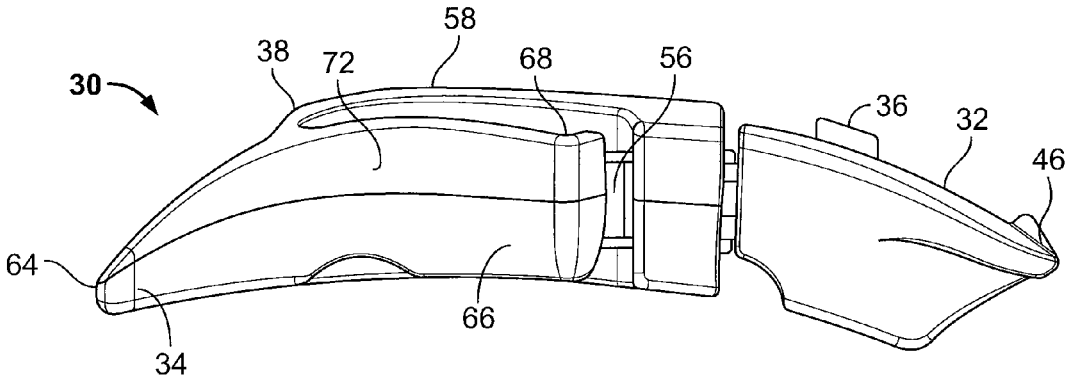
FIG. 8 illustrates a side view of a connected buckle assembly according to an embodiment of the present invention.

FIG. 7 illustrates an isometric top view of the connected buckle assembly 30, while FIG. 8 illustrates a side view of the connected buckle assembly 30. As shown in FIGS. 7 and 8, the strap beam 64 of the female connection member 34 is recessed below the shroud 58. The strap beam 46 of the male connection member 32 may also be recessed below the main body 36. Because the strap beams 46 and 64 are recessed below the main bodies 36 and 38, respectively, an operator may easily manipulate the release arms 66.

The release arms 72 may inwardly bow in order to indicate optimal areas for grasping. Additionally, the inwardly-bowed nature of the release arms 72 provides an ergonomically comfortable area in which fingers may be stably positioned.

Figure 9:
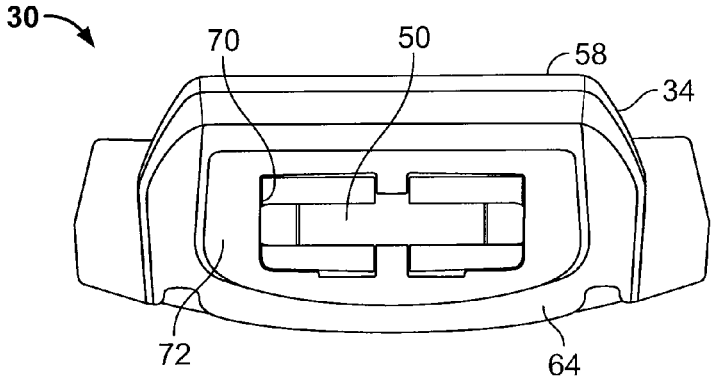
FIG. 9 illustrates an end view of a connected buckle assembly according to an embodiment of the present invention.

FIG. 9 illustrates an end view of the connected buckle assembly 30. As shown in FIG. 9, the shroud 58 includes an opening 70 formed through an end 72. The opening 70 is connected to a channel formed through the shroud 58. The opening 70 allows the blunted distal tip 50 of the extension beam 48 (not shown in FIG. 9) to pass, thereby clearing out and ejecting snow, debris or the like that may be within the inner chamber of the shroud 58. Thus, as discussed above, the process of connecting the male connection member 32 to the female connection member 34 is not hindered by the presence of foreign substances that may be within the inner chamber, because the blunted distal tip 50 extends through the opening 70, thereby pushing such substances out of the opening 70. Additionally, as discussed above, the locking arms 52 act to shunt snow, debris or the like through the button openings 60 (shown, e.g., in FIGS. 3 and 4). Because the strap bar 64 is recessed below the shroud 58 and the opening 70, the strap bar 64 does not block snow, debris or the like that is ejected from the opening 70.

Thus, embodiments of the present invention provide a robust buckle assembly having mating components that are easily connected and disconnected when desired. Unlike conventional assemblies, embodiments of the present invention include angled locking arms connected to a distal end of an extension beam, as opposed to straight arms connected to a rigid strut support that are susceptible to snapping. Additionally, embodiments of the present invention are less susceptible to being clogged with snow or debris as compared to conventional buckle assemblies. The angled locking arms act to shunt snow, debris or the like through the button openings during a connection process, while the blunted distal end of the extension beam pushes debris, snow or the like within an inner chamber of the shroud through an opening formed through the shroud.

While various spatial terms, such as upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A buckle assembly comprising:

a first buckle connector comprising engagement members; and a second buckle connector configured to connect to said first buckle connector, said second buckle connector comprising (i) a strap beam connected to a main body, wherein a strap channel is defined between said strap beam and said main body; (ii) openings formed through lateral portions of said main body in which said engagement members are retained when said first buckle connector is connected to said second buckle connector, and (iii) release arms configured to be actuated to engage said engagement members in order to disconnect said first buckle connector from said second buckle connector, wherein a portion of said first buckle connector extends out through said second buckle connector into said strap channel when said first buckle connector is connected to said second buckle connector.

2. The buckle assembly of claim 1, wherein said first buckle connector further comprises an extension beam and locking arms angled with respect to said extension beam, wherein one of said engagement members is located on a distal end of each of said locking arms.

3. The buckle assembly of claim 1, wherein said portion that extends through said second buckle connector when said first buckle connector is connected to said second buckle connector is a blunted tip.

4. The buckle assembly of claim 1, wherein said release arms are located on either side of said second buckle connector.

5. The buckle assembly of claim 1, wherein said second buckle connector comprises stops positioned proximate said openings.

6. The buckle assembly of claim 1, wherein said strap beam is recessed with respect to said main body.

7. The buckle assembly of claim 1, wherein said release arms comprise protuberances inwardly directed toward said openings, said protuberances being configured to pass into said openings when said first buckle connector is being disconnected from said second buckle connector.

8. A buckle assembly comprising:

a male connection member comprising first and second buttons; and a female connection member configured to connect to said male connection member, said female connection member comprising (i) a strap beam connected to a shroud having first and second button openings in which said first and second buttons, respectively, are retained when said male connection member is connected to said female connection member, wherein a strap channel configured to receive and retain a strap or web is defined between said strap beam and said shroud, (ii) first and second release arms extending laterally from said strap beam, said first and second release arms being configured to be actuated to engage said first and second buttons, respectively, in order to disconnect said male connection member from said female connection member, and (iii) first and second stops positioned proximate said first and second button openings, respectively, each of said first and second stops comprising a rounded end connected to a web stop edge, said stops configured to block the strap or web from passing into said first and second button openings.

9. The buckle assembly of claim 8, wherein said male connection member further comprises an extension beam connected to a cross beam and first and second locking arms extending from, and angled with respect to, said extension beam, wherein said first button is located on a distal end of said first locking arm, and said second button is located on a distal end of said second locking arm.

10. The buckle assembly of claim 9, wherein said locking arms act to shunt foreign substances through said female connection member and out of said first and second button openings when said male connection member is connected to said female connection member.

11. The buckle assembly of claim 8, wherein said male connection member further comprises a blunted tip that extends through a passage formed through said female connection member into said strap channel when said male connection member is connected to said female connection member, said blunted tip acting to push foreign substances within said passage into said strap channel when said male connection member connects to said female connection member.

12. The buckle assembly of claim 8, wherein said first release arm is located on a first side of said female connection member, and said second release arm is located on a second side of said female connection member.

13. The buckle assembly of claim 8, wherein said strap beam is recessed with respect to said shroud.

14. The buckle assembly of claim 8, wherein said first and second release arms comprise first and second protuberances, respectively, said first and second protuberances being inwardly directed toward said first and second button openings, respectively, said first and second protuberances being configured to pass into said first and second button openings when said male connection member is being disconnected from said female connection member.

15. A buckle assembly comprising:

(a) a first connection member comprising:

an extension beam connected to a cross beam, wherein a tip of said extension member is blunted;

first and second locking arms extending from, and angled with respect to, said extension beam; and first and second buttons at free ends of said first and second locking arms, respectively; and (b) a second connection member configured to connect to said first connection member, said second connection member comprising:

a main body having a passage and first and second button openings in which said first and second buttons, respectively, are retained when said first connection member is connected to said second connection member;

first and second release arms laterally extending from a strap beam around said first and second button openings, said first and second release arms being configured to be actuated to engage said first and second buttons, respectively, in order to disconnect said first connection member from said second connection member, wherein said strap beam is connected to said main body and is recessed with respect to said main body, a strap channel is defined between said strap beam and said main body, and wherein said second connection member further comprises first and second stops positioned proximate said first and second button openings, respectively, each of said first and second stops comprising a rounded end integrally connected to web stop edge, said first and second stops being configured to block a web or strap from passing into said first and second button openings.

16. A buckle assembly comprising:

(a) a first connection member comprising:

an extension beam connected to a cross beam, wherein a tin of said extension member is blunted;

first and second locking arms extending from, and angled with respect to, said extension beam; and first and second buttons at free ends of said first and second locking arms, respectively; and (b) a second connection member configured to connect to said first connection member, said second connection member comprising;

a main body having a passage and first and second button openings in which said first and second buttons, respectively, are retained when said first connection member is connected to said second connection member;

first and second release arms laterally extending from a strap beam around said first and second button openings, said first and second release arms being configured to be actuated to engage said first and second buttons, respectively, in order to disconnect said first connection member from said second connection member, wherein said strap beam is connected to said main body and is recessed with respect to said main body, a strap channel is defined between said strap beam and said main body, and wherein said tip of said extension beam extends through said passage into said strap channel when said first connection member is connected to said second connection member.

17. The buckle assembly of claim 15, wherein said locking arms act to shunt foreign substances through said female connection member and out of said first and second button openings when said male connection member is connected to said female connection member.

18. The buckle assembly of claim 15, wherein said first release arm is located on a first side of said second connection member, and said second release arm is located on a second side of said second connection member.

19. The buckle assembly of claim 15, wherein said first and second release arms comprise first and second protuberances, respectively, said first and second protuberances being inwardly directed toward said first and second button openings, respectively, said first and second protuberances being configured to pass into said first and second button openings when said first connection member is being disconnected from said second connection member.

20. The buckle assembly of claim 16 further comprising:

stops laterally extending from said main body into said openings, each of said stops comprising a rounded end integrally connected to a web stop edge, said stops being configured to block a web or strap from passing into said openings.

* * * * *